United States Patent [19]

Roberts

[11] Patent Number: 4,854,003

[45] Date of Patent: Aug. 8, 1989

[54] FLEXIBLE RECEPTACLE FOR COLLECTING AND TRANSPORTING LOOSE DEBRIS

[76] Inventor: John W. Roberts, 9908 E. Bexhill Dr., Kensington, Md. 20895

[21] Appl. No.: 204,112

[22] Filed: Jun. 8, 1988

[51] Int. Cl.[4] ..... B65D 33/06

[52] U.S. Cl. ..... 15/257.5; 15/257.9; 224/259; 294/1.1; 383/16

[58] Field of Search ..... 15/257.5, 257.6, 257.9, 15/257.1; 224/259; 294/1.1; 383/16

[56] References Cited

U.S. PATENT DOCUMENTS

| | | | |
|---|---|---|---|
| 422,240 | 2/1980 | Marshall | 15/257.8 |
| 1,308,263 | 7/1919 | Smith | 383/16 |
| 1,625,191 | 4/1927 | Condon | 383/16 |
| 1,782,354 | 11/1930 | Keene | 383/16 |
| 2,438,860 | 3/1948 | Miller . | |
| 2,732,872 | 1/1956 | Hurdle et al. | 383/16 |
| 3,106,303 | 10/1963 | Finocchiaro | 214/85 |
| 3,312,263 | 4/1967 | Wahlstrom . | |
| 3,747,653 | 7/1973 | Ringer | 15/257.1 |
| 3,830,423 | 8/1974 | Prescott | 15/257.5 |
| 4,159,139 | 6/1979 | Gawedzinski | 15/257.1 |
| 4,548,372 | 10/1985 | Lutzker | 294/1.1 |
| 4,615,743 | 10/1986 | Bylenga | 15/257.9 |
| 4,664,348 | 5/1987 | Corsaut et al. | 15/257.1 |

*Primary Examiner*—Stephen P. Garbe

*Attorney, Agent, or Firm*—Neuman, Williams, Anderson & Olson

[57] ABSTRACT

A bag for collecting and transporting loose debris such as leaves, twigs, grass cuttings and the like in which the bag mouth is held open and positioned to receive the debris by a person, with the top of the bag mouth hung behind the person by a shoulder harness attached thereto and the bottom of the bag mouth being moved along the ground by the person's feet, engaged in stirrups which are secured to the bottom of the bags. A wear strip is provided along the bottom forward edge of the bag mouth to protect against wear and to serve as a guide means to guide the debris into the bag. A handle is provided at the rear end of the bag to facilitate transport, handling and emptying.

13 Claims, 2 Drawing Sheets

FIG. 1
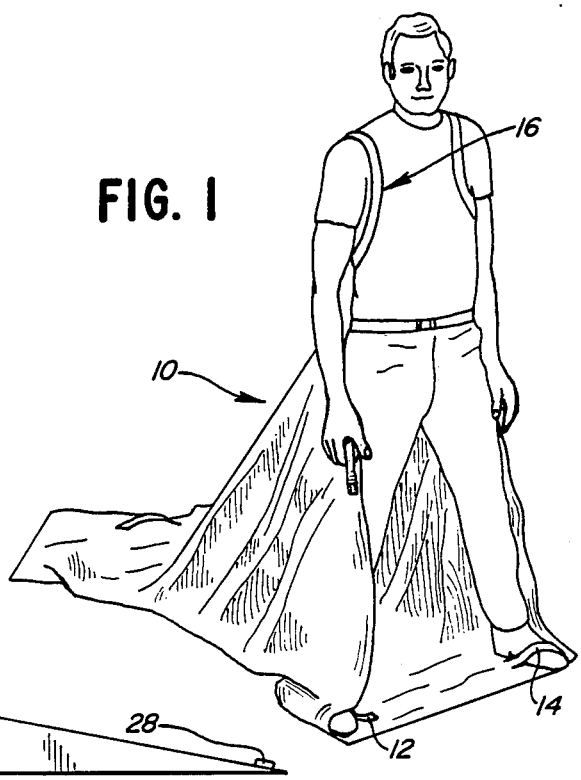
FIG. 2
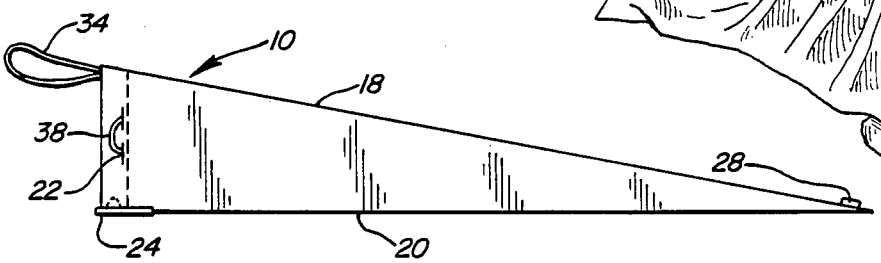
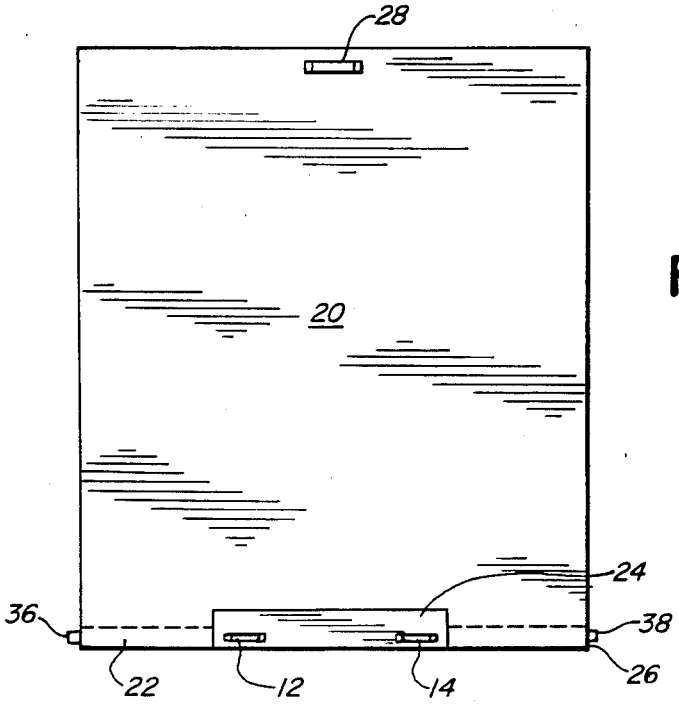
FIG. 3

FIG. 4
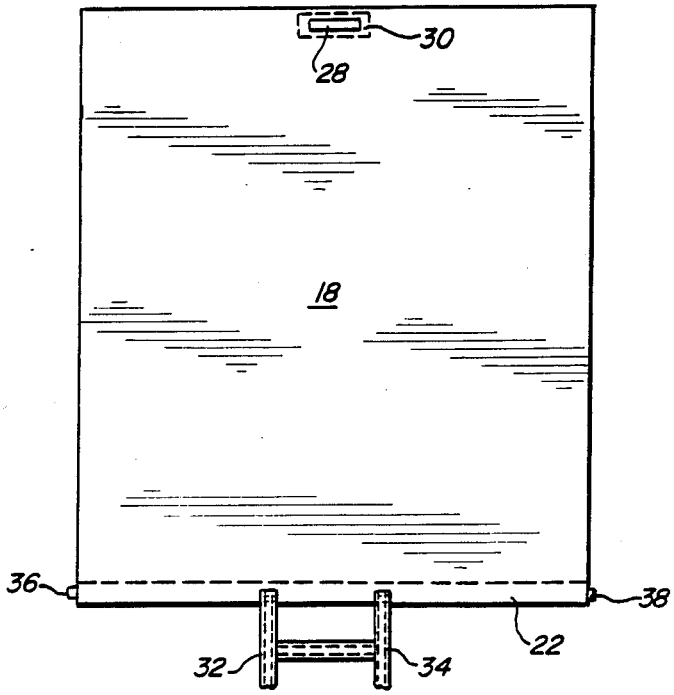
FIG. 5
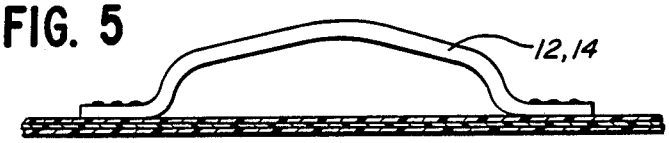
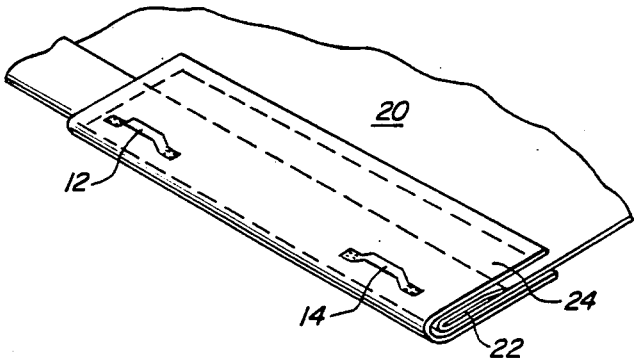
FIG. 6
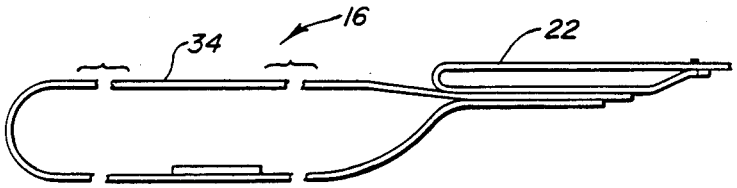
FIG. 7

FLEXIBLE RECEPTACLE FOR COLLECTING AND TRANSPORTING LOOSE DEBRIS

BACKGROUND OF THE INVENTION

This invention relates to a receptacle for use in collecting and disposing of debris such as leaves, twigs, grass cuttings and the like. More particularly, it relates to a bag which is held open and positioned to receive debris by a person, with the top of the bag mouth hung behind the person's shoulder and the bottom moved along the ground by the person's feet, engaged in stirrups secured to the bottom of the bag.

The widespread enactment of laws which prohibit the burning of leaves and other trash has created practical difficulties in the collection and disposal of loose debris. Although plastic trash bags are frequently used for these tasks, they are not entirely satisfactory. The flexible and flimsy nature of these bags has posed problems with spillage and tearing, notwithstanding the use of an assortment of support devices for such bags. Examples of known prior art support structures for these trash bags are disclosed by and in Corsaut U.S. Pat. No. 4,664,348 and Gawedzinski U.S. Pat. No. 4,159,139. Even with such support structures, however, the use of plastic trash bags involves considerable wasted effort owing to bending, stooping, lifting or carrying.

Others have proposed receptacles for collection or transport of debris which do not have all of the problems and inconveniences associated with plastic trash bags. See, for example, Ringer U.S. Pat. No. 3,747,653. Such devices, however, are frequently complex in their fabrication and awkward in their use, requiring that one hand be used to position and hold the device while lawn or other debris is being raked into the receptacle.

The present invention provides a novel bag for the collection and transport of debris which holds the mouth end of the bag in an open condition advantageous for filling and permits the free use of both hands for the raking operation. Since no ground support means are employed to prop the bag open, it can be used to collect debris in a variety of locations and it is not necessary to rake or sweep the debris into piles before collection.

SUMMARY OF THE PRESENT INVENTION

It is an object of the present invention to provide an improved receptacle for the collection and transporting of debris. More specifically, it is an object to provide a lawn bag having shoulder straps and stirrups which permit hands-free use, thus facilitating the raking and collection operation.

It is another object to provide a bag for the collection of lawn debris which is constructed of durable materials and of such a size as to accommodate large quantities of debris before emptying, yet is also of relatively low weight and easy to carry.

It is still another object of the present invention to provide a bag which is easily folded for storage purpose, and can be easily carried when empty or full.

It is still another object to provide an article which can be made using mass production techniques and which is susceptible to being packaged and retailed in a compact form at a reasonable price.

Generally, the objects of the present invention are accomplished in a bag when the mouth end is propped open by a person by way of a shoulder harness extending from the upper lip of the bag's mouth end and a pair of stirrups attached to the lower lip of the bag's mouth end. A person raking leaves or other lawn debris dons the shoulder harness and places his feet in the stirrups such that the bag extends behind him and is oriented and located by the person's forward walking movement. The user may then conveniently use both hands to rake debris towards himself, through the space between his legs and into the bag. Since the bag moves with the user, there is no need to rake the debris into multiple piles for collection. Moreover, the user carries the bag behind him automatically and doesn't have to bend and stoop over to hold the bag open or to lift it or to relocate it. The debris collection bag of the present invention is constructed in a durable manner and fabricated of a nylon material which promotes quick drying and prevents ripping, rotting and mildew.

While the invention disclosed herein has been described primarily with reference to a bagger of lawn debris, it is to be understood that it is within the scope of the invention to provide a bag for collecting other types of debris from a variety of surfaces which incorporates the same novel features.

BRIEF DESCRIPTION OF THE DRAWINGS

For a more complete understanding of this invention, reference should be made to the drawings, as briefly described below:

FIG. 1 is a perspective view of the present invention showing how it is held open by a person using the shoulder harness and stirrups.

FIG. 2 is a schematic cut-away side view of a bag fabricated according to the present invention, showing the shoulder harness and stirrups.

FIG. 3 is a plan view of the inside face of the bottom panel of a bag fabricated according to the present invention, showing a wear strip and a pair of spaced stirrups, with one handle located on each side, midway down the bag mouth, affixed to the forward edge.

FIG. 4 is a plan view of the outside face of the top panel of a bag fabricated according to the present invention, showing a handle at the rearward edge and a pair of shoulder straps affixed to the forward edge, with one handle located on each side, midway down the bag mouth, affixed to the forward edge.

FIG. 5 is an enlarged detail view of a stirrup as employed in the bag of the present invention.

FIG. 6 is an enlarged detail view of the wear strip and stirrups employed in the bag of the present invention.

FIG. 7 is a broken side view of the shoulder, straps employed in the bag of the present invention.

DESCRIPTION OF THE PREFERRED EMBODIMENT

Referring now to FIG. 1, a person is shown along with the bag 10 for collecting and transporting lawn debris of the present invention. Further shown are the stirrups 12 and 14 at the bottom inside lip of the bag and the shoulder harness 16 which extends from the top of the bag.

In keeping with the aforestated objectives, the bag 10 is fabricated as illustrated in FIGS. 2–7. In the preferred embodiment, bag 10 is fabricated from two panels, a top panel 18 and a bottom panel 20. Panels 18 and 20 are sewn together along three sides to form the bag 10 with one open or "mouth" end, as shown in FIG. 2. In the preferred embodiment of the present invention, bag 10 is fabricated of reinforced nylon and measures approximately 88 inches long by 78 inches wide. To prevent fraying of the mouth end of the bag, each of panels 18 and 20 is fabricated with a hem 22 approximately 3 inches wide. All other seams have a 1 inch hem, to prevent fraying as well.

As shown more particularly in FIG. 3, a vinyl wear strip 24, measuring approximately 12 inches wide by 32 inches long is folded in half lengthwise to cover a portion of the forward edge 26 of the bottom panel 20. The vinyl wear strip 24 can be attached at edge 26 by sewing, stapling or a variety of means. It serves the dual purpose of protecting bag edge 26 against wear and serving as a stiffening guide means to facilitate the introduction of lawn debris into the bag during the raking operation. Also, wear strip 24 is flexible enough to conform to a variety of surfaces and thereby prevent lawn debris and the like from being raked or swept under as opposed to inside the bag 10. Furthermore, and as also shown in FIG. 6, wear strip 24 acts in combination with hem 22 to provide a reinforcing member at the places were stirrups 12 and 14 are sewn to the bottom panel 20 of bag 10.

In the preferred embodiment of the present invention, stirrups 12 and 14 are formed from a 1 inch elastic strap or ⅜" bungi strap material formed in a half loop and sewn to the forward edge 26 of the bottom panel 20, as shown in FIG. 5. It will be appreciated that the exact placement of the stirrups can vary within the teachings of the present invention. It has, nevertheless, been determined that the stirrups 12 and 14 are conveniently situated approximately 28 inches apart in the preferred embodiment.

Referring back to FIG. 2, and also looking at FIG. 4, it can be seen that the top panel 18 of bag 10 is provided at its rearward edge with a handle 28 to facilitate the transport, handling and emptying of bag 10. Handle 28 may be fabricated in a number of ways; it has been found that a 1½ or 2 inch nylon webbing material performs satisfactorily in this application. In the preferred embodiment, the handle 28 is constructed of 1½ or 2 inch nylon webbing and is sewn into the bag 10 adjacent the bottom seam which joins panels 18 and 20. A reinforcing strip 30 is used to more securely retain handle 28. Handles 36 and 38 are used to assist in moving the bag during the raking operation, and are attached on each side of the seam joining panels 18 and 20 and are sewn into hem 22. In the preferred embodiment, the two handles 36 and 38 are constructed of 1½ or 2 inch nylon webbing and are sewn equidistant on each end from the seam that joins panels 18 and 20. The 3 inch hem at the front edge of the bag is used as reinforcement to help retain the straps when they are sewn into it.

Opposite handle 28 on panel 18 are shoulder straps 32 and 34 which form a part of the shoulder harness 16, shown in FIG. 1. Once again, it will be appreciated that there are a number of designs for a shoulder harness which is suitable for the purposes of the present invention. In the preferred embodiment, two straps 32 and 34 of 1½ or 2 inch nylon webbing material are sewn into the forward edge of top panel 18 through the hem 22, as shown in FIG. 7. An elastic strap may be positioned to connect the shoulder straps 32 and 34 across the back, to help keep the straps on the shoulders of the person who is engaged in the collection activity.

The collection bag 10 is easily used. When empty, the bag 10 is readily collapsed, folded and carried by handle 28. When it is time to use the bag, the user positions himself at the mouth end of the bag and faces away from the rear end of the bag, such that the bag extends behind the user. The user then steps back into the mouth of the bag, places on the shoulder harness 16, and then places his feet through the stirrups 12 and 14. At this point, the bag is propped in an open condition ready for filling. The user then can walk forward to the point of collection and use both hands to readily rake or sweep the lawn or other debris towards himself, in between his legs and into the bag 10. At the conclusion of the loading operation, the user simply releases his feet from the stirrups 12 and 14, grasps both front handles 36 and 38 in one hand, grasps handle 28 in the other hand, and pulls or carries the bag to a designated location for storage or emptying. The shoulder harness 16, handles 36 and 38 and the handle 28 can be used to facilitate the carrying and emptying of the bag 10.

From the description thus far provided, it is apparent that the proposed bag for the collection and transporting of lawn debris may be used in a number of applications and that a number of modifications can be made in the invention disclosed, by those having the benefit of the foregoing teachings, without departing from the spirit of these principles. Accordingly, while the invention disclosed herein has been described with reference to illustrations of the presently contemplated best mode for practicing the invention, it is intended that this invention be limited only by the scope of the appended claims.

What is claimed is:

1. A flexible receptacle for collecting and transporting loose debris comprising:

(a) a closed end;

(b) a mouth end opposite said closed end having an upper and a lower lip;

(c) a harness attached to said upper lip for securing said upper lip to the upper body of a person raking lawn debris; and (d) stirrups attached to said lower lip adapted to receive such person's feet;

such person thereby acting as a prop, when wearing said harness and stirrups, to support said flexible receptacle mouth end in an open position and to position said lower lip in sufficient proximity to the ground whereby loose debris can be readily introduced into the flexible receptacle, said flexible receptacle mouth end being located and oriented by such person's forward movement.

2. The flexible receptacle of claim 1 wherein said harness is a shoulder harness.

3. The flexible receptacle of claim 1 wherein said lower lip is fitted with guide means to prevent wear and to facilitate the introduction of lawn debris into said mouth end.

4. A bag for collecting and transporting loose debris comprising:

(a) a rectangular bottom panel having a spaced pair of stirrups attached to its forward edge; and (b) a rectangular top panel having harness means attached to its forward edge;

said bottom and top panels sewn together at their rearward edges and along their sides to form a bag having a mouth end with said harness means and stirrups adapted to be fitted to a person raking loose debris, such person acting as a prop, when wearing said harness means and stirrups, to support said bag mouth end in an open position and to position the forward edge of said bottom panel in sufficient proximity to the ground whereby loose debris can be readily introduced into the bag between such person's legs, said bag mouth end being located and oriented by such person's forward movement.

5. The bag for collecting and transporting lawn debris of claim 4 wherein a wear strip is folded about the forward edge of said bottom panel, to prevent bag fraying and wear and to prevent lawn debris from being raked under the bag, and wherein said stirrups are sewn to said wear strip.

6. The bag for collecting and transporting lawn debris of claim 4 wherein a handle is attached to the rearward edge of said top panel to facilitate transport, handling and emptying of the bag.

7. The bag for collecting and transporting lawn debris of claim 4 wherein a handle is attached to the forward edge of said bag mouth end to facilitate transport, handling and emptying of the bag.

8. The bag for collecting and transporting lawn debris of claim 4 wherein said harness means comprises a pair of shoulder straps connected by a back strap.

9. The bag for collecting and transporting lawn debris of claim 4 wherein said bottom and top panels are fabricated of a nylon material which promotes quick drying and prevents ripping, rotting and mildew.

10. The bag for collecting and transporting lawn debris of claim 5 wherein each of said stirrups is comprised of elastic material which is formed into a half loop by sewing the ends thereof to the forward edge of said rectangular bottom panel through said wear strip.

11. A bag for collecting and transporting loose debris comprising:

(a) a flat rectangular bottom panel;

(b) a flat rectangular top panel;

(c) a wear strip secured about the forward edge of said bottom panel to prevent bag fraying and wear and to prevent loose debris from being raked under the bag;

(d) a pair of stirrups formed by loops of elastic material, sewn to the forward edge of said bottom panel through said wear strip, adapted to receive a person's feet;

(e) a handle sewn to the rearward edge of said top panel and two handles which are each sewn to a side of the mouth of the bag, said handles facilitating the transport, handling and emptying of the bag; and (f) a pair of shoulder straps sewn to the forward edge of said top panel adapted to be worn by a person;

said bottom and top panels sewn together at their rearward edges and along their sides to form a bag having a mouth end with shoulder straps and stirrups adapted to be worn by a person raking loose debris, such person acting as a prop, when wearing said shoulder straps and stirrups, to support said bag mouth end in an open position and to position the forward edge of said bottom panel in sufficient proximity to the ground whereby loose debris can be readily introduced into the bag by raking same between such person's legs, said bag mouth end being located and oriented by such person's forward movement.

12. A method of collecting loose debris comprising:

(a) providing a bag with a closed end and an open mouth;

(b) securing spaced portions of the open mouth end of said bag to the upper body and to the feet of a user such that the user stands in the open mouth end of said bag facing opposite said closed end with his legs spaced apart to permit access therebetween of loose debris; and (c) sweeping loose material from in front of the user through the space between the user's legs and into the bag.

13. A method of collecting and transporting loose debris comprising:

(a) providing a bag with a closed end and an open mouth;

(b) securing spaced portions of the open mouth end of said bag to the upper body and to the feet of a user such that the user stands in the open mouth end of said bag facing opposite said closed end with his legs spaced apart to permit access therebetween of loose debris; and (c) sweeping loose material from in front of the user through the space between the user's legs and into the bag; and (d) moving said bag to a subsequent collection or emptying location by the forward walking motion of the user.

* * * * *